US005915071A

United States Patent [19]

Harbin, III

[11] Patent Number: 5,915,071

[45] Date of Patent: Jun. 22, 1999

[54] STEAM CLEANING APPARATUS

[75] Inventor: Benjamin F. Harbin, III, Huntsville, Ala.

[73] Assignee: National Sanitizer Inc., Huntsville, Ala.

[21] Appl. No.: 08/802,424

[22] Filed: Feb. 18, 1997

[51] Int. Cl.[6] ..... F22B 1/28; B65D 45/00

[52] U.S. Cl. ..... 392/401; 220/315

[58] Field of Search ..... 392/379, 382, 392/383, 384, 385, 400, 401, 324, 333, 335; 220/315, 316; 200/50.02, 50.12, 50.1

[56] References Cited

U.S. PATENT DOCUMENTS

| | | | |
|---|---|---|---|
| 2,785,272 | 3/1957 | Baly | 392/400 |
| 3,997,759 | 12/1976 | Osrow et al. | 200/50.1 |
| 4,721,260 | 1/1988 | Bolivar | 220/316 |
| 4,752,423 | 6/1988 | Wong | 392/402 |
| 5,050,778 | 9/1991 | Corrado et al. | 220/316 |
| 5,758,108 | 5/1998 | Fowler, Jr. | 392/402 |

*Primary Examiner*—Teresa Walberg
*Assistant Examiner*—Sam Paik
*Attorney, Agent, or Firm*—John C. Garvin, Jr.; Harold W. Hilton

[57] ABSTRACT

A steam cleaning machine including a housing enclosing a steam generator including a tank provided with a water inlet and a steam delivery connectable to a hose having a cleaning tool attached thereto for steam cleaning a surface. A pressure responsive locking mechanism is provided to lock a cover member in place over the water fill plug of the tank to prevent access thereto while the tank is pressurized. A plurality of safety mechanisms are provided to, respectively, shut off electrical power to the machine if the external surface temperature of the tank exceeds a predetermined value; to shut off electrical power to the tank if the internal tank pressure exceeds a predetermined value; to shut off electrical power to the water heating element in the tank responsive to the water level being too low; to shut off electrical power to the machine if the pressure responsive mechanism (mentioned supra) is not actuated; and, to enable the user to disconnect the hose connector from the machine without physically touching the hose connector.

17 Claims, 9 Drawing Sheets

STEAM CLEANING APPARATUS

FIELD OF THE INVENTION

This invention relates generally to a steam cleaning apparatus for cleaning surfaces quickly and easily. More particularly, the invention relates to such a steam cleaning apparatus having a plurality of safety features including both electrical and steam activated mechanisms.

BACKGROUND OF THE INVENTION

The effectiveness of steam to clean and degrease is well known. Steam not only removes dirt thoroughly from surfaces it also has an appreciable sanitizing and bacterial effect. The present invention provides a steam cleaning system that utilizes very high temperatures under regulated pressures.

However, since such high temperatures and pressures are generated in the apparatus of the present invention some safety measures must be relied upon to protect the user. The present invention, therefore, includes pressure responsive means to prevent accidental or untimely opening of the inlet of a water steam generator tank while the tank is under pressure.

A further feature of the present invention is the provision of an electrically actuated switch which prevents the electrical power from reaching any of the electrically actuated components of the apparatus if the pressure responsive means, discussed supra, is not actuated.

Additionally, a heat sensing member is provided in contact with the outside surface of the steam generator tank to sense the outside surface temperature of the tank and to shut-off power to the apparatus if a predetermined tank surface temperature has been reached.

Furthermore, a heat responsive member is provided in the steam generating tank to shut off power to the heating element in the tank responsive to the water level in the tank being too low.

A further feature of the present invention is the provision of an electrically actuated switch which prevents electrical power from reaching any of the electrically actuated components of the apparatus if the pressure responsive means, discussed supra, is not actuated.

A still further feature of the present invention is the provision of a pressure responsive switch which shuts off electrical power to the water heating element if the switch senses a tank pressure above a predetermined level and permits the heating element to be electrically reactivated when a predetermined low pressure level is reached.

Still furthermore, the apparatus is provided with a quick disconnect coupling between the tank outlet and hoses which are connected to the tank and which direct steam from the tank to the surface to be cleaned. A normally operable release mechanism is provided to release male and female members of the quick disconnect coupling without the need for the users hands to engage the relatively hot surfaces of the quick disconnect member.

SUMMARY OF THE INVENTION

The steam cleaning apparatus of the present invention comprises a housing enclosing a steam generator including a tank having a water inlet fill plug mounted in the tank water inlet and pressure responsive means for preventing accidental or untimely opening of the fill tank plug which opens the tank to the atmosphere while the tank is under pressure.

Other electrically actuated or pressure responsive safety features are provided which either shuts off power to the apparatus to electrically shut down the whole apparatus or to interrupt electrical power to the heating element to prevent further operation of the heating element.

It is, therefore, an object of the present invention to provide a steam cleaning apparatus which cleans surfaces quickly and easily and which is provided with a plurality of features which permits safe use of the apparatus.

Other objects and advantages of the present invention will be more readily apparent from the accompanying drawing, description, and claims.

BRIEF DESCRIPTION OF THE DRAWINGS

As seen in FIG. 6 the unlocking mechanism is engaging the female member for displacement thereof to unlock the male and female members.

DESCRIPTION OF THE PREFERRED EMBODIMENT

Figure 1:
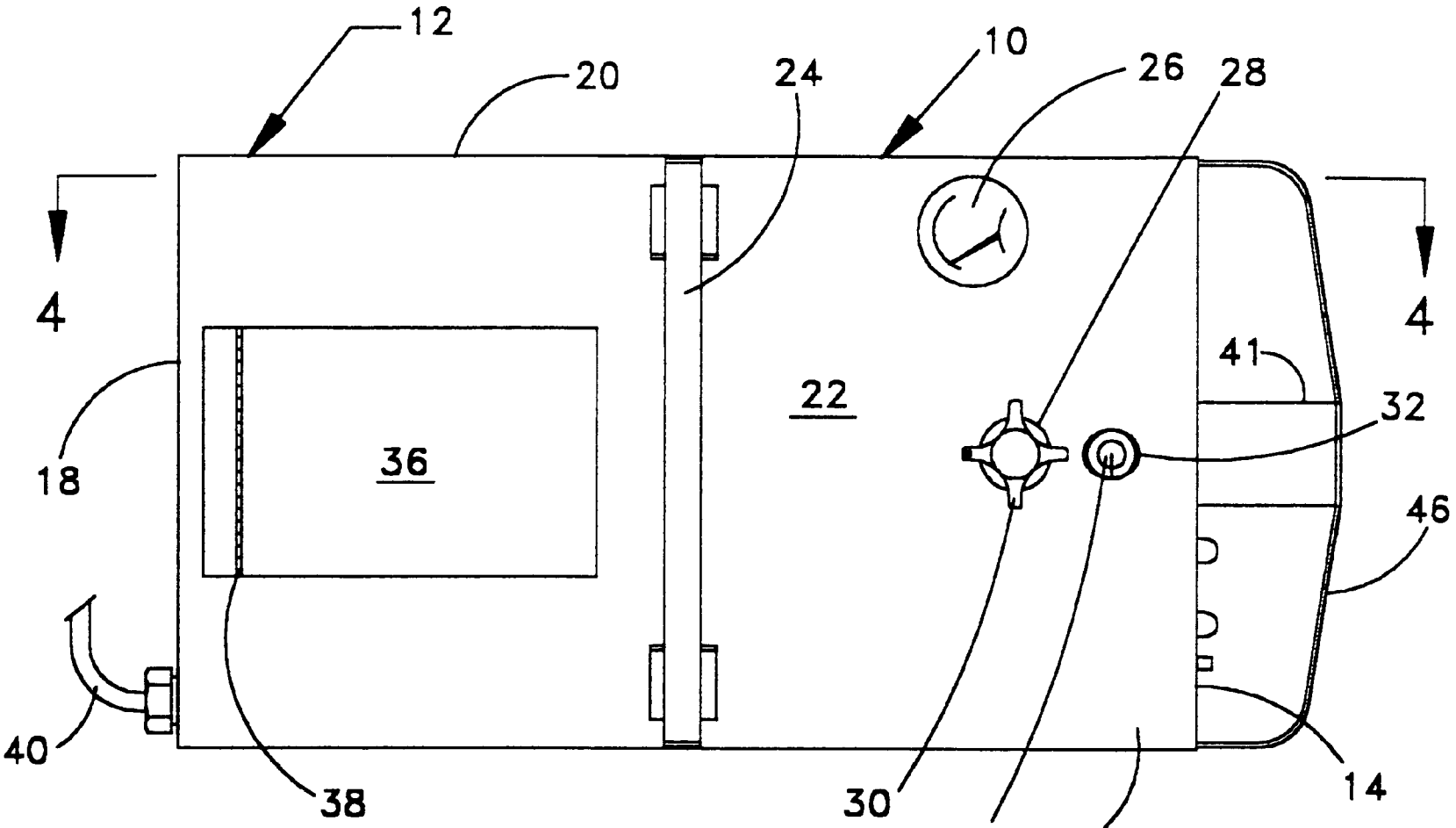
FIG. 1 is a top view of the apparatus of the present invention with the top lid in proper closed position.

FIG. 1, which is a top view of the present invention, illustrates the steam cleaning apparatus 10 of the present invention as including a housing 12 defined by sides 14, 16, 18 and 20 and a cover 22. A handle 24 shown on cover 22 is provided to aid in lifting the apparatus. A pressure gauge 26 is mounted on cover 22. Cover 22 is also shown to include an opening 28 through which a control knob 30 extends and a second opening 32 through which a second knob 34 extends for reasons explained hereinbelow. A lid 36 is pivotally hinged at 38 to cover member 22. The structure and function of 36 is set forth in detail hereinbelow. An electrical power line 40 enters housing 12 through side 18.

Figure 2:
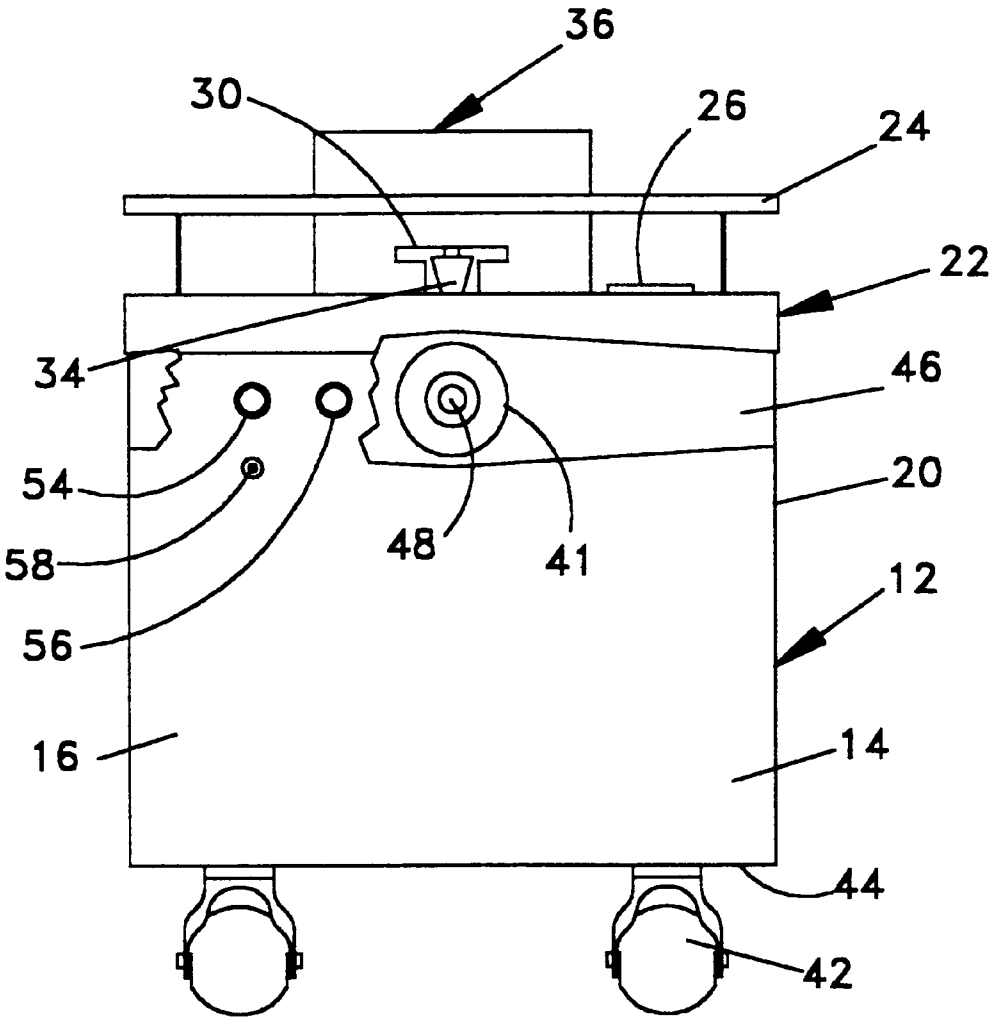
FIG. 2 is a front view of the steam cleaning apparatus of FIG. 1.
Figure 3:
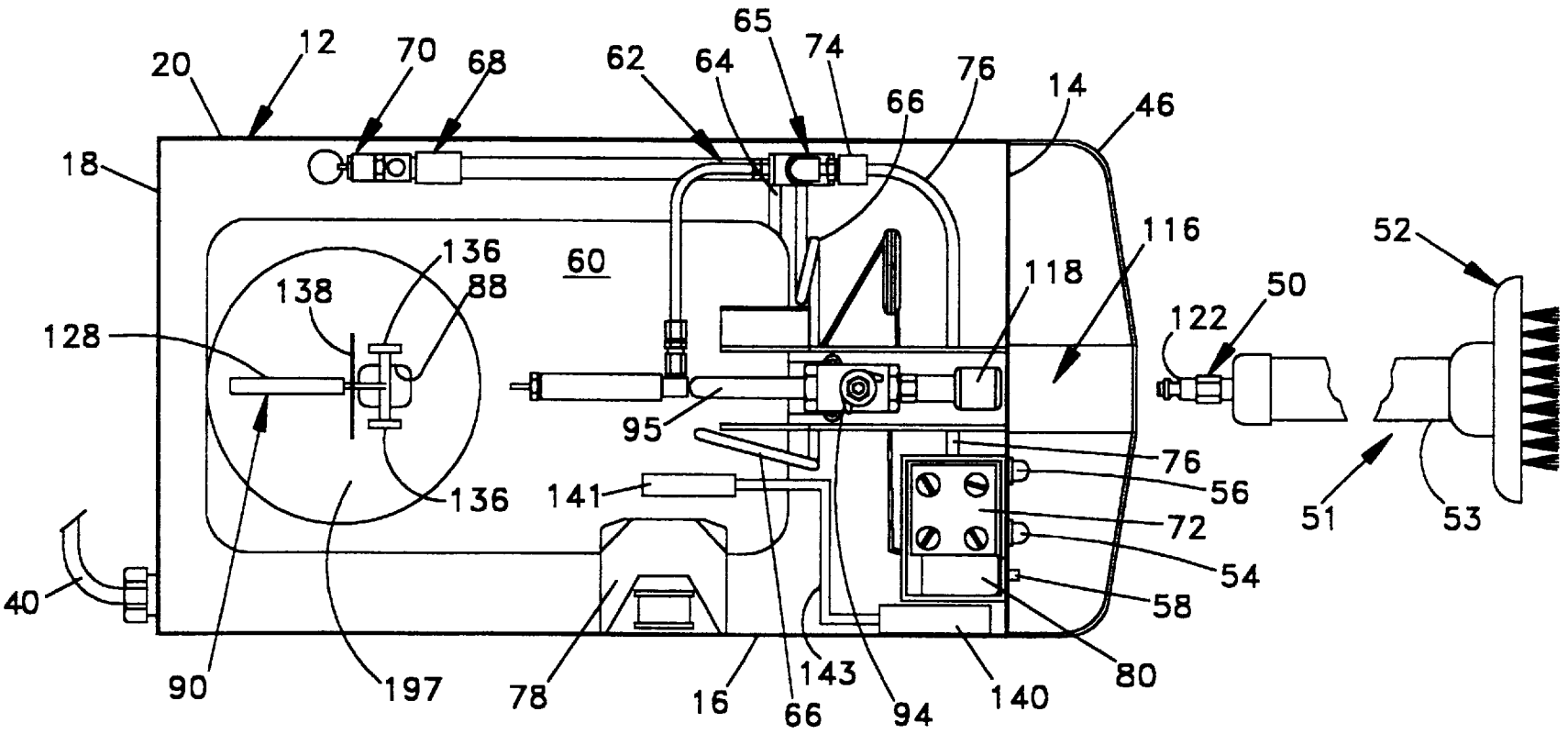
FIG. 3 is a top view similar to FIG. 1, however, the top lid has been removed to illustrate the components of the apparatus, including a steam producing tank, enclosed in the housing.

FIG. 2 is a front elevational view of the apparatus of the present invention. As seen in FIG. 2, wheels 42 are mounted to the bottom 44 of housing 12 to provide portability to the apparatus. An end support or guard member 46 is mounted to the front side 14 of the housing and includes a tubular member 41 having an opening 48 which is disposed to receive a male end 50 of hose 51. Hose 51 is disposed to receive a steam cleaning tool 52 at the second end 53 thereof as seen in FIG. 3. Indicator lights 54 and 56 are mounted on front side 14 as is a thermostat reset button 58. Light 54 indicates that power is being received by the machine. Light 56 indicates that the heating element 82 (FIG. 4) is receiving power.

End support member 46 (FIG. 2) is a curved stainless steel member extending across the front of the housing and protects indicator lights 54 and 56 and reset button 58 from impact damage. When the curved support member is bumped against an obstacle, the curvature of the support member will cause the housing 12 to slide off the obstacle, thus, allowing freedom of movement of the machine while it is in operation.

FIG. 3 is a top view of the steam cleaning apparatus with the cover 22 removed. As seen in FIG. 3, a tank 60 is mounted in housing 12 and a steam conduit 62 is mounted to tank 60 by a bracket 64. Conduit 62 has one end 65 plumbed into tank 60 via a steam line 66. Conduit 62 includes a distal end 68 having a pop-off valve 70 secured thereto. A pressure switch 72 is connected to a cross-fitting 74 in conduit 62 through a steam line 76. Pressure switch 72 is set at a predetermined pressure range and shuts off power to the water heating element if switch 72 senses a pressure above a predetermined level and permits the heating element to be powered up when a predetermined low pressure level is reached.

Figure 9:
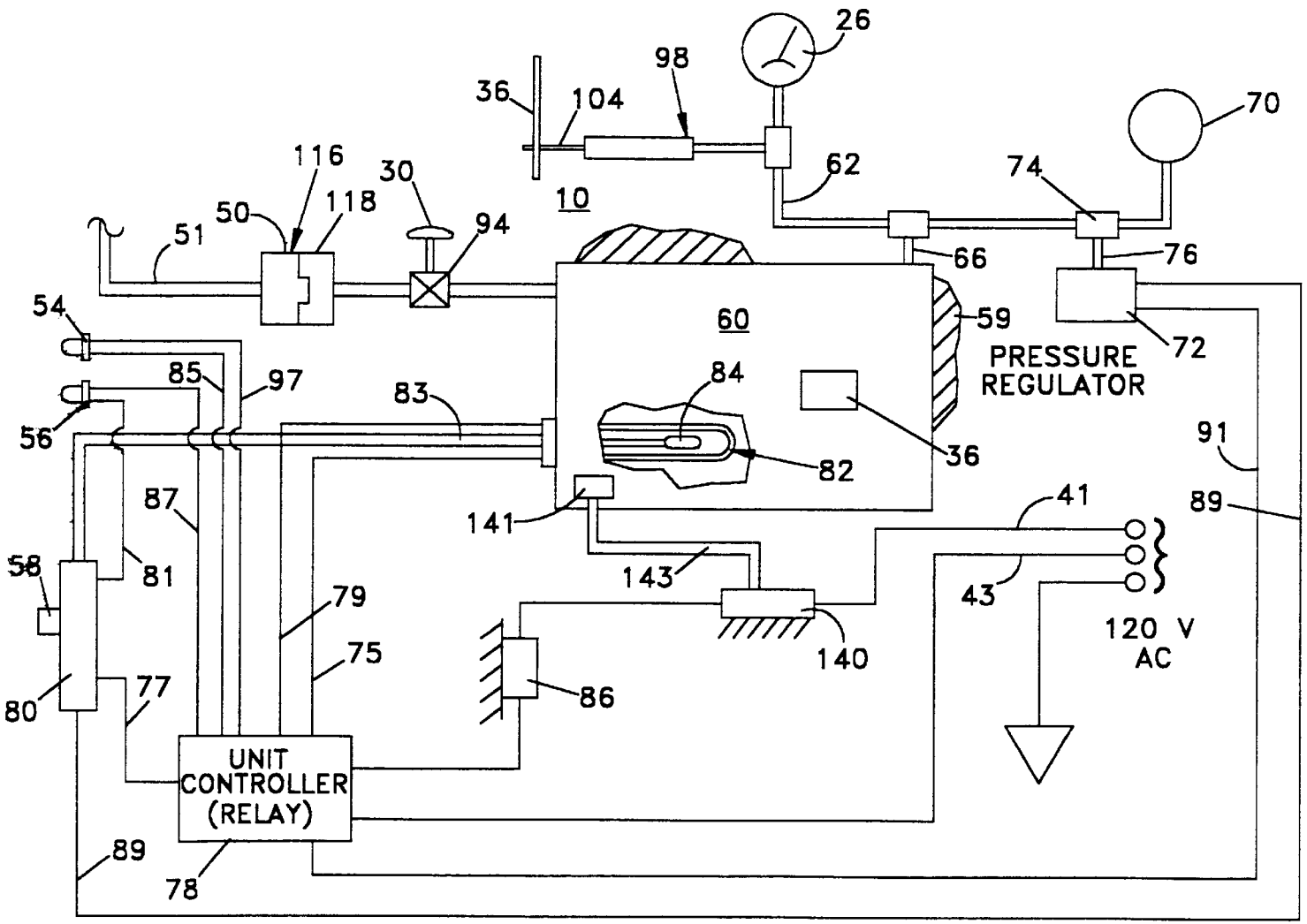
FIG. 9 is a block diagram of the steam cleaning apparatus of the present invention and includes both electrical and steam lines.

A unit controller or relay 78 is shown in FIG. 3 to be mounted to side 16 of housing 12. Relay 78 is electrically connected to the AC source 40 (FIG. 9). Relay 78 is to control the electrical flow from the AC source 40 to the electrical components of the apparatus 10, such as a thermostat housing 80 having a circuit breaker therein and the abovementioned reset button 58 thereon. Thermostat housing 80 is shown to be mounted on side 14 of housing 12. Other elements controlled through relay 78 is a heater (resistive) element 82 (FIG. 4) mounted in the steam tank, indicator lights 54 and 56 mounted on front side 16, and, the abovementioned pressure switch 72.

Relay 78 is an electrically actuated relay which is connected to the electrical input of the machine. The relay includes an electrical coil, which is actuated by inlet power, to be energized and cause a magnetic contact member to close contact points in the relay causing electrical continuity to exist between the incoming leads and outgoing leads. When the relay is not energized all of the contacts are open and no electrical continuity exists. One such relay 78 is distributed by Furnas Electric Co. of Batavia, Ill.

The pressure switch 72 may be similar to that distributed for Air System Pressure. The pressure switch as used herein employs a diaphragm which expands as the pressure from the tank increases. At approximately 150 PSI the pressure switch 72 relay contacts are open to break electrical continuity to relay 78. Relay contacts, in pressure switch 72 close at approximately 120 PSI and restore electrical continuity to relay 78.

Relay 78 is shown in FIG. 9 to be electrically connected to the AC source 40 through leads 41 and 43. Resistive element 82 is shown (FIG. 9) to be electrically connected to relay 78 through leads 75 and 79. Thermostat 80 is shown to be electrically connected to the relay 78 through lead 77. Thermostat 80 is connected to the thermostat probe 84 through a hollow or capillary tube 83. Light 54 is shown to be electrically connected to relay 78 through electrical leads 85 and 97. Light 56 is shown to be electrically connected to thermostat 80 and, thus, to the mechanical reset button 58 through electrical lead 81 and to relay 78 through electrical lead 87.

The thermostat operates on the principle of liquid expansion. A temperature change in the liquid-filled sensing system, which consists of (as seen in FIG. 9) a probe 84, a capillary 83, and, an expansion capsule, not shown, but mounted in the thermostat housing 80. The capsule produces a volume change in response to temperature changes detected by probe 84. The resultant movement of a diaphragm mounted adjacent the expansion capsule acts through a mechanism to operate a microswitch to break electrical contacts carried in the thermostat housing. The temperature probe alone senses the temperature. Reset button 58 resets contacts (not shown) to provide electrical continuity in the thermostat housing. The contacts are opened when the oil in the capillary and expansion tube is heated up and expanded to break the contacts. One such thermostat is identified as JUMO Series EM and is distributed by JUMO Process Control, Inc., 735 Fox Chase, Coatesville, Pa. 19320.

Pressure switch 72 is shown to be electrically connected to thermostat 80 and thus to reset button 58 through electrical lead 89 and to relay 78 through electrical lead 91.

As can be determined in FIG. 9, if the water level in tank 60 is below the level of the thermostat probe 84 and the probe is not immersed in water, the probe temperature increases. When a predetermined temperature (approximately 400 degrees) is reached the probe 84 will heat up the oil in tube 83 and the capsule in the thermostat housing, to shut off power to the heating element and indicator light 56 and power light 54. This will indicate to the user that the water level is too low. When switch 80 is tripped because of excessive temperature, the tank must be refilled with water and reset button 58 must be reset to power the machine back up.

Also, it is to be understood that if pressure switch 72 senses a pressure above 150 PSI a signal is sent through leads 89 and 91 to relay 78 to shut down heating element 82. If pressure switch 72 sense a pressure below 120 PSI a signal is sent through lead 89 and 91 to relay 78 to energize heating element 82.

As seen in FIG. 3, tank 60 is provided with a fill opening 88 to receive water therein. A fill plug 90 seals the tank after the tank has been filled with water. Element 82 (FIGS. 4 and 11) heats the water to the desired temperature to create steam at 150 PSI, and, when this temperature is reached and steam is generated, a control valve 94 is opened by knob 30 (FIG. 4) to permit steam to flow from tank 60 through a steam line 95 to a hose 51 and then to the tool 52 mounted on the distal end of hose 51. Valve 94 has "off", "run", and "drain" positions and is secured in a steam outlet line 95 to control steam flow from the tank to the cleaning tool 52. In the "off"

position no steam flows through the valve. In the "run" position steam flows to tool 52 and in the "drain" position steam is vented from the tank through the hose.

Figure 4:
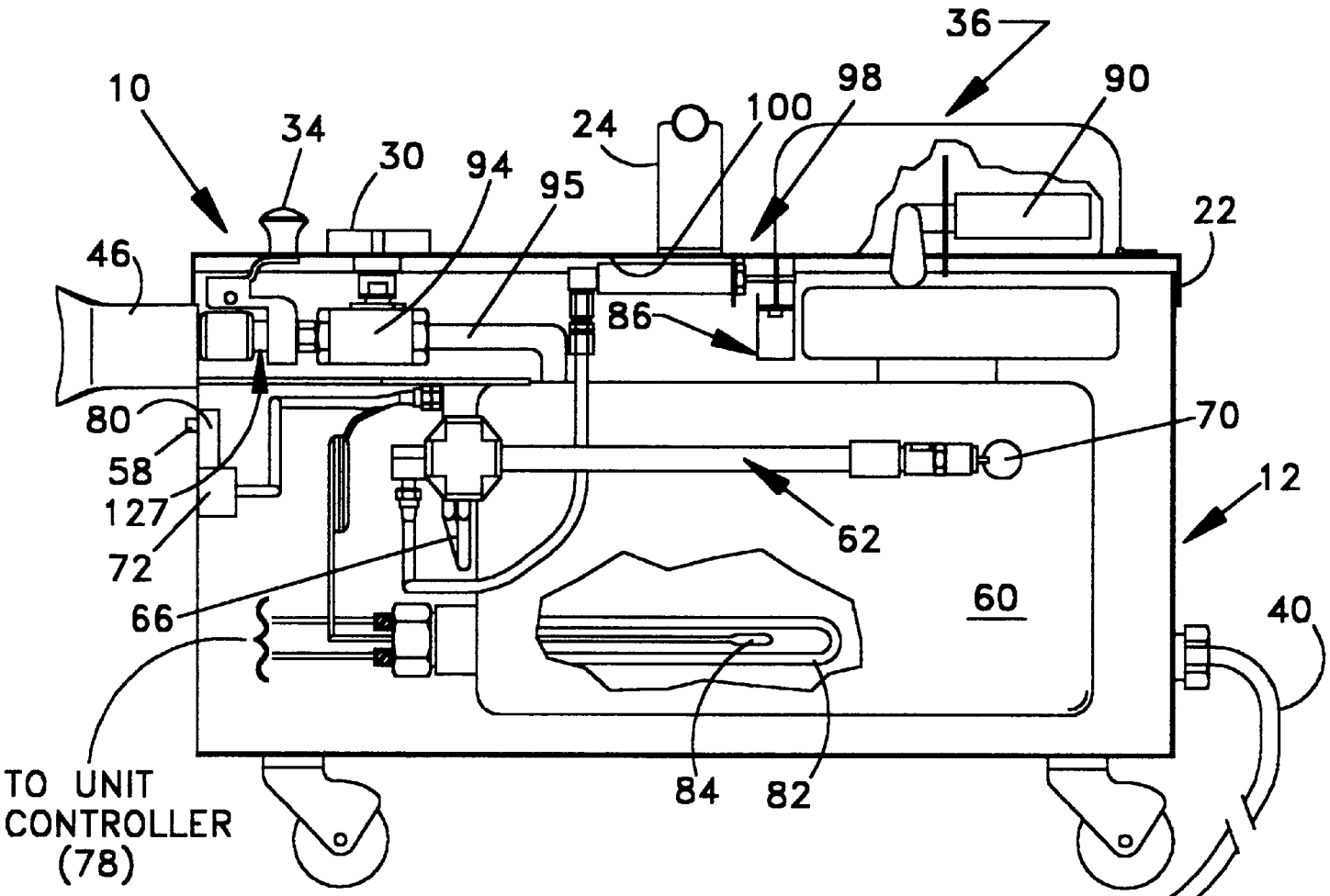
FIG. 4 is a side elevational, sectional, cut-away view taken along line 4—4 of FIG. 1 and illustrates the steam cleaning apparatus of the present invention as having a closed safety lock lid, which protects the water inlet fill plug, shown in closed position, against accidental opening. The tank and associated plumbing is also shown.
Figure 11:
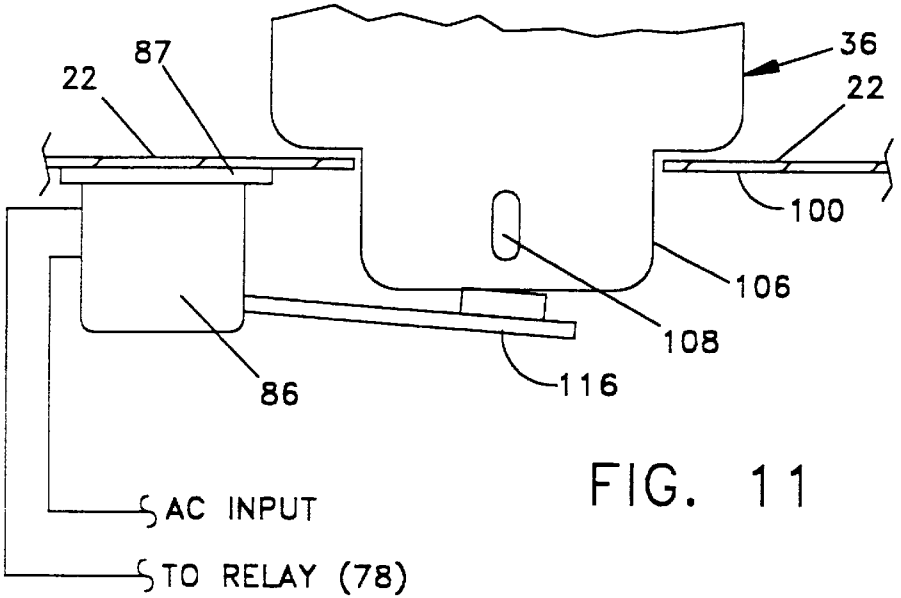
FIG. 11 is an enlarged view taken along line 11—11 of FIG. 5.
Figure 10:
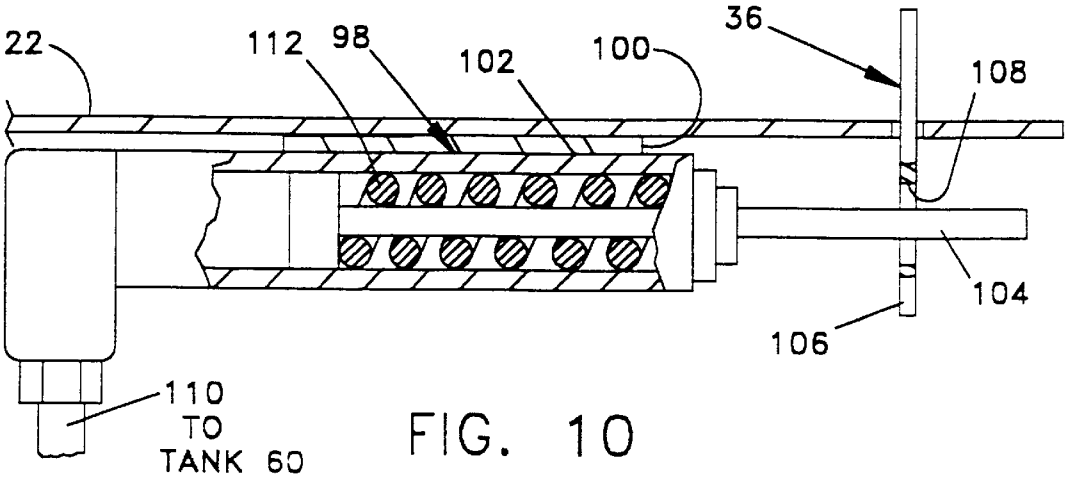
FIG. 10 is an enlarged partially sectional view of the safety interlock mechanism of FIG. 4 which locks the safety closure member in closed position to prevent accidental access to the tank fill plug.

To prevent access to the fill plug 90 when the tank 60 is pressurized, and, thereby avoid accidental opening of the tank, lid 36 is locked in a closed position as shown in FIG. 4. In this position, an interlock mechanism 98, which is secured to the underside 100 of the top 22 of the housing, secures the lid 36 in a locked position. Mechanism 98 (FIG. 10) includes a housing 102 having a plunger member 104 slidably mounted therein. The lid 36 is provided with a front, downwardly extending lip portion 106 having an opening 108 therethrough into which the plunger member 104 extends upon actuation of mechanism 98 (FIG. 11). To actuate mechanism 98, a steam line 110 connects mechanism 98 to tank 60 and when the pressure in the tank reaches a predetermined value (typically 4 PSI) the plunger 104 is held extended against the bias of a spring 112 mounted in the actuator housing 102 while the plunger is positioned in the opening or lid 108. When the tank is vented or when the apparatus is shut-off, the pressure in the tank drops below the predetermined value and the plunger 104 is moved against the bias of the spring 112 to disengage plunger 104 from lip portion 106 of lid 36 thus permitting the closure member 36 to be moved upwardly and thereby provide access to the fill plug 90.

As a further safety feature, a lid switch 86 is secured to the inner surface of top 22 by a bracket 87 (FIG. 11). The lid switch (dead man switch) is wired in series as shown in FIG. 11 to relay 78, and operates irrespective of the relay. Lid switch 86 opens and closes based on lid 36 being opened and closed. Lid switch 86 includes a plunger or lever 116 (FIG. 11) which is depressed by lip portion 106 of the lid when lid member 36 is pivoted to a closed position. In the closed position lever 116 causes electrical contacts in lid switch 86 to be engaged thereby completing the electrical circuit through the switch and permitting electrical power to reach electrical components of the apparatus including and the heating element 82. Pivoting member 36 upwardly opens the switch and interrupts the circuit.

Figure 5:
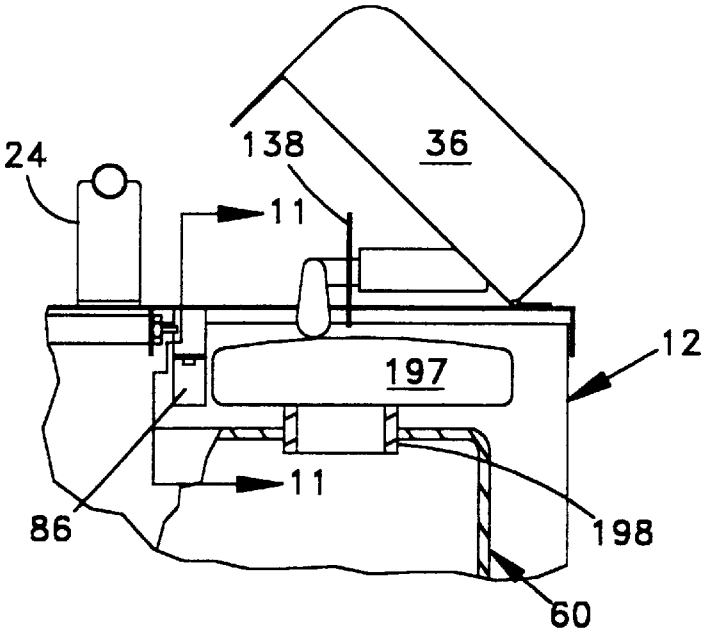
FIG. 5 is an enlarged elevational view of the safety lock lid of FIG. 4 in open position.

An additional safety feature of the present invention is the provision of a bonnet 197 (FIGS. 5 and 8) which is connected to tank 60 by a 1" stainless steel nipple 198 which extends a predetermined distance (approximately 1 inch) to create an air space in top of tank 60. Nipple 198 prevents overfilling of the tank by creating a vacuum in the upper portion of the tank. Baffle 197 is provided with a specific volume to disperse the remaining 4 PSI of pressure in the tank if fill plug 90 is forced open. The upper surface of bonnet 197 is slightly domed (instead of flat) to prevent swelling and distortion thereof when heated.

A hose interlock assembly 116 is provided to connect hose 51 to tank 60 and includes a female interlock member 118 (FIG. 3) which receives male member 50 of the hose assembly 51 therein in releasable secured relation. The female member 118 contains mechanism (not shown) to seal off the passage therein when the male member 50 is disengaged. The seal mechanism is opened as a result of a male member 50 being inserted in the female member thereby creating a steam flow path from the tank through hose 51. The female member is spring biased to a normally closed position and is opened against the bias of the spring when the male member is inserted. Such connectors are well known in the art.

Figure 6:
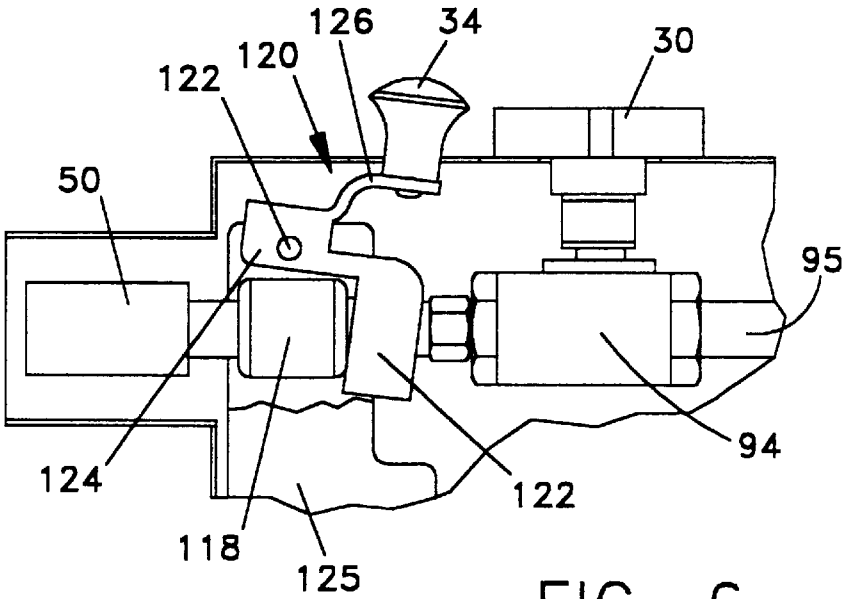
FIG. 6 is a partial elevational view of a hose interlocking mechanism housed in the cleaning apparatus which engages the female member of a quick release connector to the external male member of a hose to disengage the female member from the male member of the hose interlock mechanism.
Figure 7:
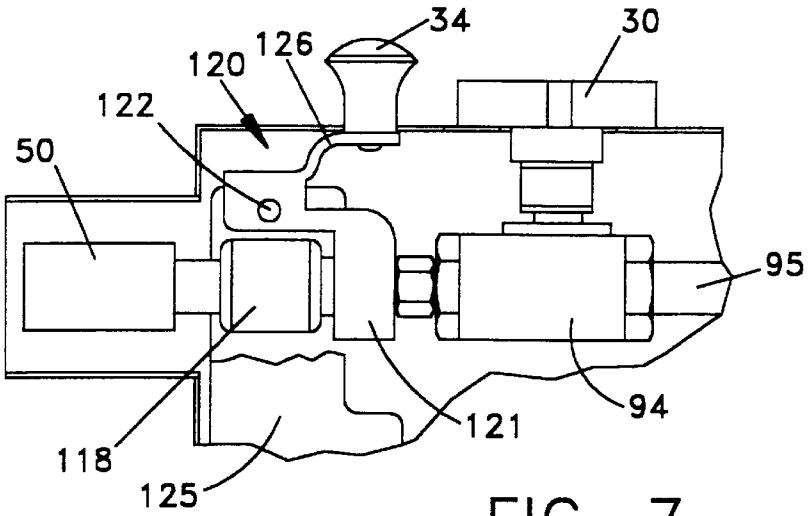
FIG. 7 is a view similar to FIG. 6 but illustrates the unlocking mechanism if unengaged relation with the female member of the quick release connector.

Typically when the male and female members 50 and 118 of interlock assembly 116 are engaged the female member slides back and a plurality of balls therein (not shown) are moved into a groove 122 of male member 50 (FIG. 3) for locked relation therewith. The present invention provides mechanism 120 to unlock the male and female members without requiring the user to touch the hot interlock assembly. As seen in FIG. 6, unlocking mechanism 120 includes a pair of downwardly extending legs 122. One leg is positioned on each side of the female member 118 and is pivotally connected by pin 122 to a member 124 from which the arms depend. Member 124 is provided with an upper leg 126 having a thread stud (not shown) extending upwardly therefrom to which knob 34 is secured. Member 124 is secured to a support member 125 which is secured to a bracket 127 which is secured to and extends from tank 60. With male and female members in engaged relation knob 34 is moved to the position shown in FIG. 6 disconnect the members by moving the female member forwardly against the bias of the spring to allow the balls to be moved out of groove 122 of the male member. FIG. 7 illustrates the assembly in released position.

Figure 8:
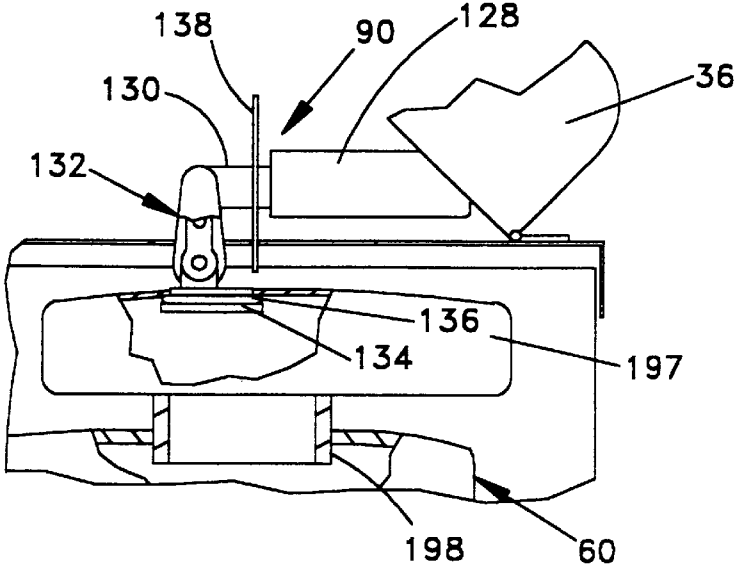
FIG. 8 is an elevational view similar to FIG. 5 but illustrates specific structure of the linkage mechanism of the steam tank fill plug. The fill plug is shown in closed position.

FIG. 8 illustrates another safety feature of the present invention. As seen in FIG. 8, fill plug 90 includes a handle 128 secured to a rod or the like 130 which is secured to a linkage assembly 132 which is in turn secured to a closure member 134 including a gasket 136. As seen in FIG. 3, fill plug 90 includes a pair of oppositely extending cam legs 136 which perform a camming action against the upper surface 125 of the tank when handle 128 is pivoted upwardly or downwardly. This camming action caused by the downward movement of handle 128 moves closure member 134 and gasket 136 upwardly against the inner upper surface 129 of the tank to seal the water inlet. Upward movement of handle 128 reverses this movement and moves closure member 134 downwardly to open the water inlet to permit the tank to be filled with water. A shield 138 is provided beneath the handle 128 and above member 134 to protect the user's hands in the event steam escapes while the fill plug is being opened.

Yet another safety feature of the present invention is the use of a thermal cut-off switch 140 (FIG. 3) electrically connected in the incoming leg 124 of the power cord 40 as seen in FIG. 9.

The thermal cut off switch is similar to the switch 80 and probe 84. A probe 141 which is connected by capillary 143 to cut off switch 140 is positioned on the top of the tank (FIGS. 3 and 9), underneath the insulation to read the tank surface temperature. The thermal cut-off is used to protect the machine from overheating if any two components fail to shut the machine off. The normal low water cut-off would tell the relay 78 to cut power to the machine at about 400 degrees; however, if the relay failed to cut power, the thermal cut-off device 140 would continually be reading the temperature of the surface of the tank. At about 480 degrees the probe 141 heats the oil in tube 143 to break contacts in switch 140 (as discussed supra, in conjunction with switch 80) to shut off power to the machine.

It should be noted that the reset switch of thermostat 80 (FIG. 9) is electrically connected to relay 78, pressure switch 72, and indicator light 56 so as to shut off electrical power to these components if the water level in tank 60 falls below the level of the thermostat as a result of the thermostat reading undesirable temperatures in the tank. Reset button 58 resets these circuits when proper operating conditions are again reached.

It is to be understood that the tank and other steam carrying lines are insulated by insulation 59 to retain the heat therein and to prevent anyone from coming into contact with hot surfaces of various elements of the machine.

It is also to be understood that an "on-off" switch may be provided in the power inlet leads to turn the apparatus on or off, if desired.

Figure 12:
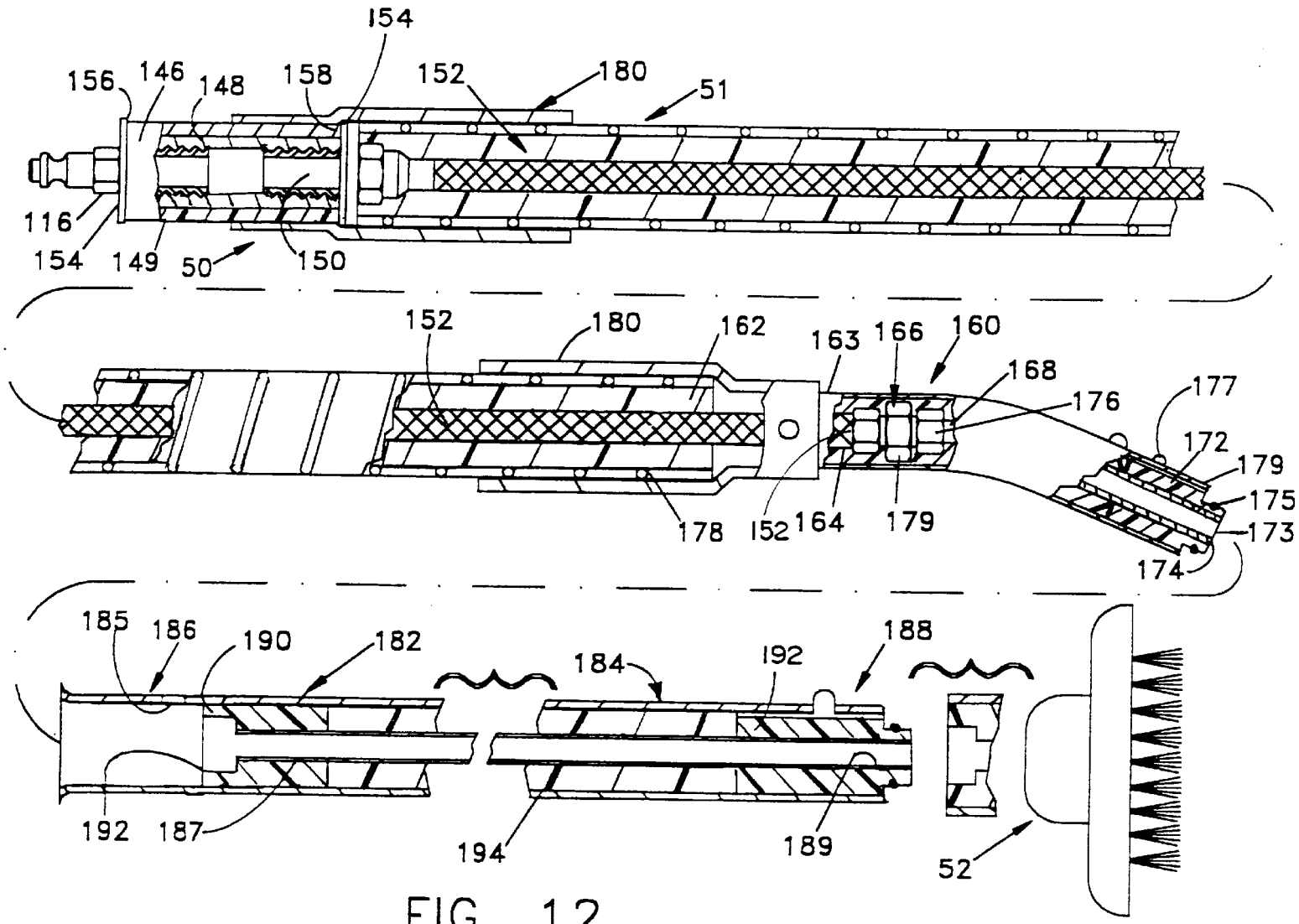
FIG. 12 is an elevational view, partially in section, of the hose assembly adapted for use with the steam cleaning apparatus of the present invention.

The hose assembly 51 (as shown in FIG. 12) is specifically engineered and designed to withstand high heat and pressure. The machine end or steam inlet 50 includes a teflon rod 146 having a stainless steel nipple 148 pressed into rod 146 and turned down a small amount to prevent slipping inside the Teflon rod 146. Nipple 148 is threaded internally to accept male interlock member 116 on one end 149 thereof and threaded internally on the other end 150 to accept a stainless steel flexible hose 152. Stainless steel washers 154 are put on both end surfaces 156 and 158 of rod 146. A stainless steel locking wand 160 is secured to the steam exit end 162 of hose 152. The locking wand includes a tubular member 163 enclosing flexible hose 152 which has its distal end 164 connected through a coupling assembly 166 to a stainless steel rigid tube 168 which is pressed into a Teflon rod 172. The tube 168 is flared at its distal end 174 into rod 172. A flare connector 176 and union 179 connects the flexible hose 152 and stainless steel tube 168 together in member 163. Rod 172 is provided with a projecting portion 173 to form a male coupling member. An "O" ring 175 is mounted around portion 173. A spring biased locking button 177 is provided adjacent end portion 179 of locking wand 160. The entire length of the stainless steel hose 152 and the stainless steel tube 168 is covered with a rubber insulation 176 to protect the operator from the heat and then covered with a clear Vacuf lex hose protector 178. Hose cuffs 180 are used to make the transition from the Vacuflex hose to the curved wand 160. The curved wand connects to a wand assembly 182.

Wand assembly 182 includes a tubular member 184 having a female end 186 and a male end 188. Female end 186 encloses a Teflon rod 190 which has a central opening 192 to receive projecting portion 173 of rod 172 of the locking wand 160. An opening 185 is provided in end 186 to receive locking button 177 of locking wand 160 therein. Male end 188 of tubular member 184 of the wand assembly has a Teflon rod 192 pressed therein. The opposite ends 187 and 189 of a stainless steel tubular member 194 extends through rods 190 and 192 and are pressed into rods 190 and 192. A rubber insulation is positioned around the length of tubular member 194 between rods 190 and 192. A cleaning tool 52 attaches to male end 188 of wand assembly 182.

It is to be understood that while various components of the apparatus has been described as being made of stainless steel this is not to be taken in a limiting sense, since other materials may be resorted to. Likewise, "Teflon" is used to describe certain components of the hose, however, this is not to be taken in a limiting sense since other heat insulative materials may also be used.

It is to be understood that while the above description and accompanying drawings disclose a specific embodiment of the present invention, this is to be taken in the illustrative and not limiting sense only, and that various modifications may be resorted to that is within the spirit and scope of the appended claims.

I claim:

1. A steam cleaning apparatus comprising:

a housing having a removable top, sides and a bottom forming an enclosure;

a steam generator mounted in said housing and including a tank having a water inlet and a steam delivery;

a water inlet plug means for closing said water inlet subsequent to filling said tank with water; and pressure responsive locking means means for preventing access to said closure means to prevent accidental or untimely opening thereof while said tank is subjected to internal pressure responsive to generation of steam therein, said pressure responsive locking means including a lid pivotally mounted on said top and positioned over said water inlet plug means, and, interlocking means for releasably locking said lid over said water inlet plug means, said interlocking means disposed in communication with said tank for actuation by steam pressure from said tank for locking said lid to said top of said housing to prevent access to said water inlet plug means when said tank is pressurized and for unlocking said lid from said top only when pressure in said tank is decreased to a predetermined level.

2. Apparatus as in claim 1 including heating element means carried in said tank to heat water therein to produce steam.

3. Apparatus as in claim 2 wherein said apparatus includes a plurality of electrically actuated components, and, electrical inlet means for electrically actuating said components.

4. Apparatus as in claim 3 including electrical switch means connected to said electrical inlet means to prevent actuation of any of said components unless said means for preventing access to said closure means is actuated.

5. Apparatus as in claim 4 wherein said electrical switch means is a normally open switch which is closed when said means for preventing access to said closure means is actuated.

6. Apparatus as in claim 3 including cut-off switch means electrically connected to said electrical inlet means, and, temperature sensing means mounted on the external surface of said tank and connected to said switch means for actuation thereof to prevent electrical current flow therethrough, responsive to the temperature of the tank surface exceeding a predetermined value.

7. Apparatus as in claim 6 wherein said cut-off switch means includes a thermostat switch having a heat sensing member connected thereto, said heat sensing member being mounted in contact with the external surface of said tank and disposed for actuation of said thermostat switch to prevent electrical current flow therethrough responsive to said tank temperature exceeding a predetermined level.

8. Apparatus as in claim 3 including pressure switch means connected to said heating element means to deactivate said heating element means responsive to tank pressure reaching a predetermined high level and for reactivating said heating element means responsive to tank pressure reaching a predetermined low level.

9. Apparatus as in claim 8 wherein said pressure switch means is a pressure regulator for maintaining pressure in said tank between said predetermined high level and said predetermined low level.

10. Apparatus as in claim 3 including water level sensing means, actuatable when the water level in said tank drops to a predetermined level, to deenergize said heating element means.

11. Apparatus as in claim 10 wherein said water level sensing means includes a thermostat switch having a heat sensing member connected thereto, said heat sensing element mounted in said tank and disposed for heating to a predetermined temperature when not immersed in water to deactuate said thermostat switch to prevent electrical current from reaching said heating element.

12. A steam cleaning apparatus comprising:

a housing;

a steam generator mounted in said housing and including a tank having a water inlet and a steam delivery, said steam delivery being disposed for connection to a hose having a tool on the distal end thereof for steam cleaning a surface;

closure means for closing said water inlet subsequent to filling said tank with water; and means for preventing access to said closure means to prevent accidental or untimely opening thereof while said tank is subjected to internal pressure responsive to generation of steam therein;

heating element means carried in said tank to heat water therein to produce steam;

a plurality of electrically actuated components, and, electrical inlet means for electrically actuating said components; and a quick disconnect connector having releasably mating male and female members disposed for releasably mating relation for connecting said hose to said steam delivery, and, manual disconnect means for manually disconnecting said male and female members without physically contacting the male and female members.

13. Apparatus as in claim 3 wherein housing includes a top member having a slot therein and said lid pivotally hinged to said top member, said lid having a downwardly depending portion disposed for insertion into said slot and having an opening therethrough and, pressure responsive locking means including a plunger for insertion into said opening of said downwardly depending portion of said lid responsive to pressure build-up in said tank to a predetermined level, whereby said lid is locked to said top member to prevent access to said closure means.

14. Apparatus as in claim 11 including a first indicator means disposed for energization responsive to actuation of said thermostat switch to indicate that electrical power is being received by said heating element.

15. Apparatus as in claim 11 including second indicator means disposed for actuation responsive to electrical actuation of said components to indicate that electrical power is being received by said components.

16. Apparatus as in claim 1 including steam flow control means mounted in said steam delivery means for controlling steam flow from said tank, said steam flow control means including a valve having an on position for allowing steam flow therethrough, an off position for preventing steam flow therethrough, and a drain position for draining steam from said tank.

17. Apparatus as in claim 1 wherein said tank is provided with an opening therein and said water inlet plug means is provided with a handle having a rod extending therefrom, sealing means disposed for extending into said opening and secured to one end of said rod, said rod being pivotally secured to said sealing means for sealed relation of said sealing means with said opening responsive to the pivotal movement of said handle, and, shield means positioned on said rod adjacent to and beneath said handle to shield the user's hand in the event that steam escapes when the fill plug is being opened.

* * * * *